US005338375A

United States Patent [19]

Benderly et al.

[11] Patent Number: 5,338,375

[45] Date of Patent: Aug. 16, 1994

[54] USE OF IRON SALTS AS CORROSION INHIBITORS IN TITANIUM VESSELS

[75] Inventors: Abraham Benderly, Houston; Audrey Bravo, Richardson, both of Tex.

[73] Assignee: Rohm and Haas Company, Philadelphia, Pa.

[21] Appl. No.: 139,248

[22] Filed: Oct. 18, 1993

[51] Int. Cl.[5] ..... C23C 22/00

[52] U.S. Cl. ..... 148/252; 148/269; 148/272; 148/277; 148/281; 148/284; 148/286; 148/287

[58] Field of Search ..... 148/252, 269, 272, 277, 148/281, 284, 286, 287

[56] References Cited

U.S. PATENT DOCUMENTS 4,298,404 11/1981 Greene ..... 148/252
5,160,632 11/1992 Kleefisch et al. ..... 423/367

OTHER PUBLICATIONS

I. P. Anoshchenko et al., in Werkstoffe und Korrosions 25, Jahrg. Heft Oct. 1974; pp. 749–750.

*Primary Examiner*—Richard O. Dean
*Assistant Examiner*—Robert R. Koehler
*Attorney, Agent, or Firm*—Terence P. Strobaugh

[57] ABSTRACT

A method for inhibiting the corrosion of metals exposed to aqueous mixtures of sulfuric acid and hydrocyanic acid by the use of iron salts.

12 Claims, No Drawings

USE OF IRON SALTS AS CORROSION INHIBITORS IN TITANIUM VESSELS

BACKGROUND OF THE INVENTION

Replacement of corroded equipment can be a major expense in an industrial process, both from the standpoint of equipment cost and from the standpoint of lost production during the replacement process, as well as costs for removal and disposal of the corroded equipment. In addition, maintenance costs for equipment in a corrosive environment may be high.

A number of approaches are utilized to reduce the effects of corrosive substances on metal equipment. These include fabricating the equipment from corrosion resistant materials such as titanium, zirconium or tantalum; coating or lining the equipment with corrosion resistant materials such as glass; and adding corrosion inhibiting substances to the corrosive materials. Use of corrosion resistant metals and coating of equipment with inert materials can be expensive.

When corrosion inhibiting substances are employed care must be taken to fully evaluate any proposed metal/corrosion inhibitor system, that is, the metal, the corrosive material, the inhibitor, and other components which may be present, in order to avoid unexpected results, the most important being failure to inhibit corrosion. For example, fluoride ions accelerate the dissolution of titanium oxide. Therefore, whenever fluoride ions are present, oxidizing agents generally do not work well as titanium corrosion inhibitors. In some cases low concentrations of corrosion inhibitors actually increase the corrosion rate. They only function as inhibitors at concentrations above what is known as the critical value.

In highly corrosive environments, such as occur in the presence of sulfuric/hydrocyanic acid mixtures, corrosion resistant metals are often used. Unfortunately, such acid mixtures are sufficiently corrosive that even when corrosion resistant metals are used unacceptable corrosion often occurs, especially at elevated temperatures which occur, for example, in distillation columns during distillation. For that reason, corrosion inhibitors are typically added to such mixtures.

Corrosion resistance of many of the common metals, including aluminum, iron and steel, titanium, and zirconium, is through formation of a metal oxide layer on the metal's surface. In environments where water or oxygen are present, such metals regenerate metal oxide layers spontaneously. In more aggressive environments, such as in the presence of acidic mixtures, the metal oxide layer may be depleted faster than the metal can oxidize to spontaneously regenerate it. In those cases, oxidizing agents are good choices for corrosion inhibitors because they increase the rate of oxide layer regeneration.

The most commonly used oxidizing agent inhibitors are copper salts such as copper sulfate. These salts have the advantages of having good activity as corrosion inhibitors, ready availability, solubility in aqueous solutions, and reasonable cost. Unfortunately, they also have a significant drawback. They are considered environmentally detrimental and, therefore, are difficult to dispose of in an environmentally acceptable manner. Thus, there is a need for environmentally acceptable alternatives to copper salts as corrosion inhibitors in metal vessels exposed to acidic mixtures.

I. P. Anoshchenko et al., in Werkstoffe und Korrosion 25. Jahrg. Heft 10/1974 reports that in addition to copper salts, iron salts are known to inhibit corrosion of titanium by acidic solutions such as sulfuric, hydrochloric, and phosphoric acids. However, we expected that iron salts would be ineffective for inhibiting metal corrosion in the presence of sulfuric acid/hydrocyanic acid mixtures due to the formation of Prussian blue or other iron cyano complexes. Such complexes are produced by the precipitation of ferrous ferrocyanide from a soluble ferrocyanide and ferrous sulfate at acidic pH. Iron cyano complexes are known to be insoluble in water and, therefore, would be expected to be unavailable to act as oxidizing agents on the metal surfaces in aqueous environments.

SUMMARY OF THE INVENTION

We have discovered that contrary to expectations, many iron salts act as corrosion inhibitors in the presence of aqueous sulfuric acid/hydrocyanic acid mixtures. Thus, the present invention is a method for inhibiting the corrosion of metals exposed to aqueous mixtures of sulfuric and hydrocyanic acids by the use of such iron salts.

DETAILED DESCRIPTION OF THE INVENTION

The present invention is a method of inhibiting corrosion of a metal exposed to an aqueous mixture of sulfuric acid hydrocyanic acids, comprising admixing with the aqueous sulfuric/hydrocyanic acid mixture a corrosion inhibiting amount of an iron salt.

The metal for which corrosion is to be inhibited may be any metal which forms an oxide surface which is stable, strongly adherent to the metal, and protective from the effects of acidic, oxidizing corrosive materials. Such metals include, for example, iron and iron based alloys such as steel; titanium; zirconium; and the like. Preferred metals are titanium and zirconium because of the high cost of replacing equipment made from these metals.

The composition of the iron salt anion is not critical. However, in order to act as an inhibitor it is necessary that the oxidation-reduction potential of the salt be greater than that of the metal for which corrosion is to be inhibited. In general, the greater the difference in the potential, the greater the corrosion inhibitory effect of the salt. Thus, iron (III) salts, since they have an oxidation-reduction potential on the order of 0.77 V, are preferred over iron (II) salts, which have an oxidation-reduction potential on the order of −0.44 V. Because of their low oxidation-reduction potential, iron (II) salts may increase the corrosion rate for metals with an oxidation-reduction potential greater than −0.44 V. Iron (III) salts in the form of iron complexes, such as, for example, the hexacyano complex, also may be used as inhibitors. However, care must be taken to ensure that the oxidation-reduction potential of the complex is higher than that of the metal being protected. Due to their high oxidation reduction potential, preferred iron (III) salts include the sulfate and oxalate. Most preferred is iron (III) sulfate.

The concentration of iron salt required to achieve inhibition varies with the aggressiveness of the environment. That is, as the concentration of sulfuric and/or hydrocyanic acids increases in the aqueous mixture, the amount of iron salt must also increase. This effect is more pronounced with changes in sulfuric acid concentration than with changes in hydrocyanic acid concentration. Furthermore, care must be exercised to ensure that the concentration of iron salt is maintained above an experimentally derived minimum concentration, the critical value, since corrosion may be increased by the presence of iron salt at levels below the critical value. For dilute aqueous solutions of sulfuric/hydrocyanic acids, that is, aqueous solutions with less than about 10 weight percent sulfuric acid and less than about 2500 ppm (parts per million) hydrocyanic acid, iron salt concentrations of 10–1000 ppm are adequate. When the sulfuric acid concentration is from about 0.01 weight percent to about 5 weight percent and the hydrocyanic acid concentration is from about 10 to about 100 ppmm preferred levels of iron salt are from about 50 to about 100 ppm under anaerobic conditions. Most preferred are levels from 50–75 ppm, again under anaerobic conditions. These values are for environments under an inert atmosphere. Since oxygen itself can serve as an oxidizing agent, when it is present, for example, when the mixture is aerated, iron salt levels can be reduced by a factor of about 0.5.

The following examples illustrate the present invention in greater detail. They in no way limit the invention. All percentages in the examples are by weight based on the total weight of the aqueous sulfuric acid mixtures; parts per million are based on parts per million parts of the aqueous sulfuric acid mixtures.

GENERAL PROCEDURE

Corrosion processes are evaluated by electrochemical analysis using an electrochemical cell. A standard cell consists of a working electrode of titanium or zirconium grade 2 coupons (Metal Samples Co.), two graphite counter electrodes, one calomel reference electrode connected to the cell by a salt bridge (Lugin probe), and a gas inlet tube to purge the cell with argon gas. Experiments are conducted at a temperature of 95° C. under an argon atmosphere unless otherwise specified. The cell is connected to a potentiostat (PARC EG&G Instruments model 273) coupled to a computer for data collection and data analysis. Corrosion measurement and analysis software (SOFTCORR II, © 1991, EG&G Instruments) is used to set all experimental parameters, control the experiments, and analyze the data. The following parameters are entered into the computer program prior to each experiment: conditioning potential and time, initial delay, equivalent weight, density, and sample area.

Linear Polarization Resistance ("LPR")-A control potential scan, typically over a small range +20 mV ("millivolts") of the corrosion potential at equilibrium ("$E_{corr}$") is applied to the working electrode. The resulting current is monitored and plotted against the applied potential. A line is obtained which provides values for "$E_{corr}$" and the current flow ("$I_{corr}$"). $E_{corr}$ is the potential when $I_{corr}$ is zero. The slope of the line when $E_{corr}$ is zero is used to calculate the corrosion current. The corrosion rate ("CR") is calculated from these values as follows:

$$CR = c(EW/D)(I_{corr}/A)$$

where:

c = a proportionality constant = $1.287 \times 10^5$ when $I_{corr}$ is in amperes ("A") and CR is in mills per year ("mpy")

EW = equivalent weight

D = density of the metal $I_{corr}/A$ = current density in $A/cm^2$

A metal is considered active if a corrosion rate greater than 50 mpy is found, passive if the corrosion rate is less than 10 mpy, and active-passive if it oscillates back and forth between active and passive.

Anodic Pulse-A charge of 550 mV is applied to the metal for 30 seconds. $E_{corr}$ is monitored for 30 minutes while the system equilibrates. An LPR scan is then conducted.

Cathodic Pulse-A charge of −900 mV is applied to the metal for 30 seconds. $E_{corr}$ is monitored for 30 minutes while the system equilibrates. An LPR scan is then conducted.

Potentiodynamic ("PD") Scan-A control potential scan is applied to the working electrode from −250 mV from $E_{corr}$ to 1.6 V vs the standard calomel electrode ("SCE") at a scan rate of 350 mV/second. The results of the potentiodynamic scan provide a value for $E_{corr}$ based on the potential at peak current flow. This procedure produces a "fingerprint" of the material being tested. The shape of the fingerprint may show any tendency for the metal to be active, passive, or active-passive depending on the conditions.

Potentiodynamic Scan of Metal Without Inhibitor-A cathodic charge of −900 mV is applied for 1 minute. $E_{corr}$ of the metal is monitored for 1 hour. An LPR scan is conducted followed by a Potentiodynamic Scan after the system has re-equilibrated.

Pulsing Experiment without Inhibitor-A −900 mV cathodic pulse is applied for 60 seconds to ensure the metal surface is free of oxide. $E_{corr}$ is then monitored for 1 hour. An LPR scan is then conducted. Anodic, cathodic, and then another anodic pulses are applied with equilibration and an LPR scan between each pulse. A Potentiodynamic scan from −1.0 V vs SCE to 1.5 V vs SCE is conducted after a final equilibration.

Pulsing Experiment with Inhibitor-This experiment is conducted as above except that prior to the initiation of the pulse sequence the inhibitor is added and then $E_{corr}$ is monitored for 30 minutes.

EXAMPLES

Examples 1–4

Aqueous solutions of sulfuric acid at concentrations of 0.01%, 0.1 weight percent, 1.0 weight percent and 5.0 weight percent are prepared. In each experiment a solution is placed in the electrochemical cell with either a titanium or zirconium coupon. PD and LPR scans are then conducted and CR and $E_{corr}$ are determined. Representative results of these experiments are in Table 1. The results show the expected behavior for titanium in sulfuric acid, which is a corrosive agent for titanium. The CR increases with increasing acid concentration and $E_{corr}$ decreases.

TABLE 1

| Ex. No. | $H_2SO_4$ Conc. % | Inhibitor | Conc. ppm | CR in mpy | $E_{corr}$ in V |
|---|---|---|---|---|---|
| 1 | 0.01 | — | — | 1–2 | −0.2180 |
| 2 | 0.1 | — | — | 10–20 | −0.3703 |
| 3 | 1.0 | — | — | 93 | −0.6412 |
| 4 | 5.0 | — | — | 200–280 | −0.8164 |

Example 5

This experiment is conducted using the procedure of example 2 except that copper (II) sulfate is added as an inhibitor. Representative results of this experiment are in Table 2. The results show the effect of addition of copper (II) sulfate, a known inhibitor. The addition of 10 ppm of copper (II) sulfate reduces the CR by about 5×.

TABLE 2

| Ex. No. | $H_2SO_4$ Conc. % | Inhibitor | Conc. ppm | CR in mpy | $E_{corr}$ in V |
|---|---|---|---|---|---|
| 5 | 0.1 | $CuSO_4$ | 10 | 2.17 | 0.1549 |

Examples 6–13

These experiments are conducted using the procedure of examples 2 and 3 except that iron (III) sulfate is added as an inhibitor. Representative results of these experiments are in Table 3. All the values for CR are less than 1.0 mpy indicating that iron (III) sulfate protects titanium from sulfuric acid corrosion. When compared to the effect copper (II) sulfate has on $E_{corr}$ and $I_{corr}$, iron (II) sulfate has a greater effect on $E_{corr}$ whereas copper (II) sulfate has a greater effect on $I_{corr}$. At higher acid concentrations, more iron (III) sulfate is required in order to obtain an equivalent CR (compare examples 9 and 13).

TABLE 3

| Ex No. | $H_2SO_4$ Conc. % | Inhibitor | Conc. ppm | CR in mpy | $E_{corr}$ in V |
|---|---|---|---|---|---|
| 6 | 0.1 | $Fe_2(SO_4)_3$ | 38 | 0.75 | 0.4791 |
| 7 | 0.1 | $Fe_2(SO_4)_3$ | 50 | 0.6 | 0.1259 |
| 8 | 0.1 | $Fe_2(SO_4)_3$ | 75 | 0.4 | 0.2240 |
| 9 | 0.1 | $Fe_2(SO_4)_3$ | 100 | 0.2 | 0.3668 |
| 10 | 0.1 | $Fe_2(SO_4)_3$ | 150 | 0.18 | 0.4731 |
| 11 | 1.0 | $Fe_2(SO_4)_3$ | 50 | 0.28 | 0.16 |
| 12 | 1.0 | $Fe_2(SO_4)_3$ | 75 | 0.25 | 0.20 |
| 13 | 1.0 | $Fe_2(SO_4)_3$ | 150 | 0.2 | 0.2 |

Examples 14–18

These experiments are conducted using the procedure of example 2 except that potassium ferrocyanide is added as an inhibitor. Representative results of these experiments are in Table 4.

TABLE 4

| Ex No. | $H_2SO_4$ Conc. % | Inhibitor | Conc. ppm | CR in mpy | $E_{corr}$ in V |
|---|---|---|---|---|---|
| 14 | 0.1 | $K_3Fe(CN)_6$ | 50 | 0.95 | 0.6030 |
| 15 | 0.1 | $K_3Fe(CN)_6$ | 100 | 0.4 | 0.2719 |
| 16 | 0.1 (Zr) | $K_3Fe(CN)_6$ | 100 | 2–3 | 0.6473 |
| 17 | 0.1 | $K_3Fe(CN)_6$ | 200 | 0.278 | 0.8473 |
| 18 | 0.1 (Zr) | $K_3Fe(CN)_6$ | 200 | 0.46 | 0.8801 |

(Zr) = Zirconium coupon used

Examples 19–20

These experiments are conducted using the procedure of example 2 except that iron (II) sulfate and iron (III) oxylate ($Fe(Ox)_3$) are added as inhibitors. Representative results of these experiments are in Table 5.

TABLE 5

| Ex No. | $H_2SO_4$ Conc. % | Inhibitor | Conc. ppm | CR in mpy | $E_{corr}$ in V |
|---|---|---|---|---|---|
| 19 | 0.1 | $FeSO_4$ | 500 | 0.54 | −0.3065 |
| 20 | 0.1 | $Fe(Ox)_3$ | 180 | 1.01 | 0.1709 |

Example 19 shows the effect of changing the oxidation state of the iron ion in the inhibitor. Iron (II) sulfate is much less active an inhibitor than iron (III) sulfate. We expect this is because its oxidation-reduction potential is much less (−0.440 compared to 0.771 for iron (III)). Examples 14–18 and 20 show the effect on CR of a change in the anion. Although the effect is low, these materials are still sufficiently active to inhibit corrosion. In addition, examples 14–18 show the effect that cyanide ion, from the aqueous sulfuric acid/hydrocyanic acid mixture, has on the corrosion rate. Since the presence of cyanide will lead to formation of the hexacyano iron (III) anion, this example demonstrates that the titanium is still protected from corrosion.

Examples 21–24

These experiments compare the corrosion rate with different levels of hydrocyanic acid at two different levels of sulfuric acid. The iron (III) sulfate level is maintained between 50 and 75 ppm in each of the experiments. The experiments are conducted using the procedure of examples 1–4 except that the temperature is held at 60° C. instead of 95° C. Representative results of these experiments are found in Table 6. The results show that the corrosion rate is more dependent on the sulfuric acid concentration than the hydrocyanic acid concentration. In addition, these experiments show that even at high hydrocyanic acid concentration, the corrosion rate in titanium is acceptable.

TABLE 6

| Ex. No. | $H_2SO_4$ Conc. % | HCN Conc. ppm | CR in mpy |
|---|---|---|---|
| 21 | 0.1 | 2140 | 0.34 |
| 22 | 0.1 | 2554 | 0.16 |
| 23 | 1.0 | 1063 | 2.07 |
| 24 | 1.0 | 1480 | 2.13 |

We claim:

1. A method for inhibiting corrosion of a metal, the metal forming an oxide surface when in contact with an aqueous mixture of sulfuric acid and hydrocyanic acid, comprising admixing with the aqueous sulfuric acid and hydrocyanic acid mixture in contact with the metal a corrosion inhibiting amount of an iron salt.

2. The method of claim 1 wherein the metal is selected from iron, iron alloys, steel, titanium, and zirconium.

3. The method of claim 1 wherein the metal is selected from titanium and zirconium.

4. The method of claim 1 wherein the sulfuric acid concentration in the aqueous mixture is from about 0.001 weight percent to about 10 weight percent and the hydrocyanic acid concentration in the aqueous mixture is from about 1.0 to about 2500 ppm.

5. The method of claim 1 wherein the sulfuric acid concentration in the aqueous mixture is from about 0.01 weight percent to about 5 weight percent and the hydrocyanic acid concentration in the aqueous mixture is from about 10 to about 100 ppm.

6. The method of claim 1 wherein the iron salt is an iron (III) salt.

7. The method of claim 1 wherein the iron salt is selected from iron (III) sulfate, iron (III) oxylate, and potassium ferrocyanide.

8. The method of claim 1 wherein the iron salt is iron (III) sulfate.

9. The method of claim 4 wherein the concentration of iron salt is from about 10 to about 1000 ppm.

10. The method of claim 5 wherein the concentration of iron salt is from about 50 to about 100 ppm.

11. The method of claim 5 wherein the concentration of iron salt is from about 50 to about 75 ppm.

12. The method of claim 1 further comprising aerating the mixture.

* * * * *